US007227074B2

(12) United States Patent
Ball

(10) Patent No.: US 7,227,074 B2
(45) Date of Patent: Jun. 5, 2007

(54) TRANSPORT CONTROL FOR INITIATING PLAY OF DYNAMICALLY RENDERED AUDIO CONTENT

(75) Inventor: Steven J. Ball, Seattle, WA (US)

(73) Assignee: Microsoft Corporation, Redmond, WA (US)

( * ) Notice: Subject to any disclaimer, the term of this patent is extended or adjusted under 35 U.S.C. 154(b) by 231 days.

(21) Appl. No.: 10/949,495

(22) Filed: Sep. 24, 2004

(65) Prior Publication Data

US 2006/0065104 A1 Mar. 30, 2006

(51) Int. Cl.
*G10H 7/00* (2006.01)
*G04B 13/00* (2006.01)
*A63H 5/00* (2006.01)

(52) U.S. Cl. ..... 84/609; 84/610; 84/615; 84/634; 84/649; 84/650; 84/653

(58) Field of Classification Search ..... None
See application file for complete search history.

(56) References Cited

U.S. PATENT DOCUMENTS 5,315,057 A * 5/1994 Land et al. ..... 84/601
5,753,843 A 5/1998 Fay
5,827,989 A 10/1998 Fay et al.
5,900,567 A 5/1999 Fay et al.
6,093,881 A 7/2000 Fay et al.
6,153,821 A 11/2000 Fay et al.
6,169,242 B1 1/2001 Fay et al.
6,433,266 B1 8/2002 Fay et al.
6,541,689 B1 4/2003 Fay et al.
2001/0025561 A1* 10/2001 Milburn et al. ..... 84/609
2001/0035087 A1* 11/2001 Subotnick ..... 84/600
2003/0159567 A1* 8/2003 Subotnick ..... 84/626
2005/0241465 A1* 11/2005 Goto ..... 84/616

OTHER PUBLICATIONS

Steven E. Schoenherr, Recording Technology History, http://history.acusd.edu/gen/recording/notes.html website, published Jan. 13, 2005.
Steven E. Schoenherr, 7 Digital Audio Recording Formats, http://history.acusd.edu/gen/recording/digital2.html website, published Aug. 30, 2004.
Alexander Brandon, et al., Interactive Audio Special Interest Group, Interactive Composition col. 1.1, www.iasig.org website, published Jan. 13, 2005.
Glenn McDonald, A Brief Timeline of Video Game Music, www.gamespot.com website, published Aug. 30, 2004.

* cited by examiner

*Primary Examiner*—Marlon T. Fletcher
(74) *Attorney, Agent, or Firm*—Shook, Hardy & Bacon LLP

(57) ABSTRACT

A transport control, e.g., for use with an audio content playing device, the transport control for initiating play of dynamically rendered audio content selections that are rarely, if ever, played the same way twice is provided. The transport control includes a play indicator, e.g., a play button or the like, and a control indicator, for instance, a rotatable knob. The control indicator is linearly mapped to an interactive music engine having a plurality of component engines, each of which is controlled by the control indicator. Accordingly, the control indicator is referred to herein as a "multi-purpose" indicator. Upon altering this single multi-purpose control indicator, multiple components and music elements of the output can be affected. Thus, a transport control that permits a user to initiate play of dynamically rendered music selections with little input and/or decision-making is also provided.

10 Claims, 4 Drawing Sheets

TRANSPORT CONTROL FOR INITIATING PLAY OF DYNAMICALLY RENDERED AUDIO CONTENT

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention relates to the generation of audio content. More particularly, the present invention relates to a transport control for initiating play of dynamically rendered audio content selections that are rarely, if ever, played the same way twice. The present invention further relates to a transport control that permits a user to initiate play of dynamically rendered audio content selections with little input and/or decision-making.

BACKGROUND OF THE INVENTION

The creation and performance of music has evolved greatly throughout history. For centuries prior to the 1900s, music performance consisted of live performances of improvised or composed compositions. Even with composed compositions, the nature of "live" performance was such that a piece of music was never performed quite the same way twice. Beginning in the early part of the twentieth century, as recording technology began to be developed, the fundamentals of music performance began to change as it became possible to capture a particular performance in a recorded medium and re-play it remotely at a separated instance in time. While live music performances continue to take place, playback of a particular captured audio content selection has been the state of the art in sharing music performances for a number of decades, even though the media on which the music selections are captured, distributed, and rendered has changed over time. In more recent years, music performance has evolved once again as the wide-spread digital distribution of music has made it possible for a single captured, rendered piece of music to be shared with, literally, millions of people.

While recorded music selections and the wide-spread distribution thereof have revolutionized the music industry in many positive ways, a some-what unfortunate side effect has been the loss of the unpredictability, fluidity, and dynamic nature of live performance. Recorded music selections are static and predictable and, as such, even the most avid recorded music consumers often seek the experience of a live performance through other channels.

Recorded music is currently commercially distributed in a linear form via analog cassette tapes, vinyl analog copies, audio CDs and more recently, via digital distribution of music by consumers and owners who trade and/or sell MP3/WMA/AAC compressed digital audio files. However, the music renditions being distributed through any of these media are fixed, once-rendered and captured audio performances that are played the same way each and every time they are played on a particular audio playing device.

Additionally, even though musicians working in a studio often record multiple "takes" of the same part, only one of those parts is produced and included in a particular rendition of the piece of music. For instance, a guitarist may record fifteen different guitar solos for the same song but, in the end, a producer chooses one of these fifteen, and the rest are discarded, even though twelve out of the fifteen may be interesting, valid, and musically useful takes. As such, in the end, the music rendition that is produced is a fixed and captured performance that again, plays the same way each and every time it is played on a particular audio playing device.

It should be noted that it is possible to dynamically "remix" music performances to create unique performances by combining one or more linear tracks from CDs or vinyl records or sampling devices. However, significant user-interaction is required to change a performance, the various music components and elements thereof being altered independently to create each performance. While mixing boards, complex stereo equipment, professional music authoring software and the like which permit this type of music rendering have appeal to dance club DJs and particularly astute non-DJ consumers, they are not easily useable for the average consumer. Additionally, if no user input is provided other than initiation of play, the settings on the mixing board and/or stereo equipment will remain the same and the rendered music performance will be the same each and every time it is played.

Accordingly, an audio content playing device for initiating play of dynamically rendered audio content selections that are rarely, if ever, played the same way twice would be advantageous. Additionally, an audio content playing device on which play of dynamically rendered audio content selections with little input and/or decision making on the part of the user would be desirable.

BRIEF SUMMARY OF THE INVENTION

The present invention relates to a transport control for use with an audio content playing device that permits a user, with little interaction and/or decision-making, to initiate play of a music selection which will be dynamically rendered upon play initiation and which will rarely, if ever, play the same way twice. In one aspect, the transport control includes a play indicator for initiating play of audio content and a multi-purpose control indicator which is linearly mapped to an interactive music engine. The interactive music engine includes a plurality of component engines (e.g., a mix engine, a sequence engine, an orchestration engine, a timing engine, and/or a mood engine) each of which is controlled by the multi-purpose control indicator. Additionally, each of the component engines provides input which dynamically affects the audio content which will be output upon play initiation, the audio content rarely, if ever, being output exactly the same way twice.

In another aspect, the present invention is directed to a dynamic audio content playing device which permits a user to initiate play of music selections which rarely, if ever, play the same way twice. The dynamic audio content playing device includes a transport control having a play indicator for initiating play of audio content and a multi-purpose control indicator linearly mapped to an interactive music engine. The interactive music engine includes a plurality of component engines each of which is controlled by the multi-purpose control indicator. Additionally, each of the component engines provides input which dynamically affects the audio content which will be output upon play initiation.

In yet another aspect, the present invention is directed to a user interface embodied on at least one computer-readable medium, the user interface for initiating play of dynamically rendered audio content. The user interface comprises a play indicator display area configured to display a play indicator for initiating play of audio content and a multi-purpose control indicator display area configured to display a multi-purpose control indicator which is linearly mapped to an interactive music engine. The interactive music engine includes a plurality of component engines each of which is controlled by the multi-purpose control indicator and each of which dynamically affects the audio content which will be output upon play initiation.

In a further aspect, the present invention is directed to a computer-implemented method for initiating play of dynamically rendered audio content. The method comprises receiving a indication that play of an audio content selection is to be initiated, receiving an indication of a control setting from a multi-purpose control indicator, outputting an audio input request to each of a plurality of component music engines, each of which is controlled by the multi-purpose control indicator, receiving an audio input from each of the plurality of component music engines consistent with the control setting, dynamically generating a rendition of the audio content selection based upon the received audio inputs, and outputting the rendition of the dynamically generated audio content selection. The method may be repeated multiple times without alteration of the control setting to dynamically generate audio content selections which differ from one another. As such, little user interaction and/or decision-making is required for a user to enjoy audio content selections that mimic many of the characteristics of live performance.

BRIEF DESCRIPTION OF THE SEVERAL VIEWS OF THE DRAWING

The present invention is described in detail below with reference to the attached drawing figures, wherein.

DETAILED DESCRIPTION OF THE INVENTION

The present invention provides a transport control, e.g., for use with an audio content playing device, the transport control for initiating play of dynamically rendered audio content selections that are rarely, if ever, played the same way twice. The transport control includes a play indicator, e.g., a play button or the like, and a control indicator, for instance, a rotatable knob. The control indicator is linearly mapped to an interactive music engine having a plurality of component engines, each of which is controlled by the control indicator. Accordingly, the control indicator is referred to herein as a "multi-purpose" indicator to show that the control indicator has an affect on more than ore aspect of the audio content which will be output from the playing device. Upon altering this single multi-purpose control indicator, multiple components and music elements of the output can be affected. Thus, the present invention further relates to a transport control that permits a user to initiate play of dynamically rendered music selections with little input and/or decision making.

Having briefly described an overview of the present invention, an exemplary operating environment for the present invention is described below.

Exemplary Operating Environment

Figure 1:
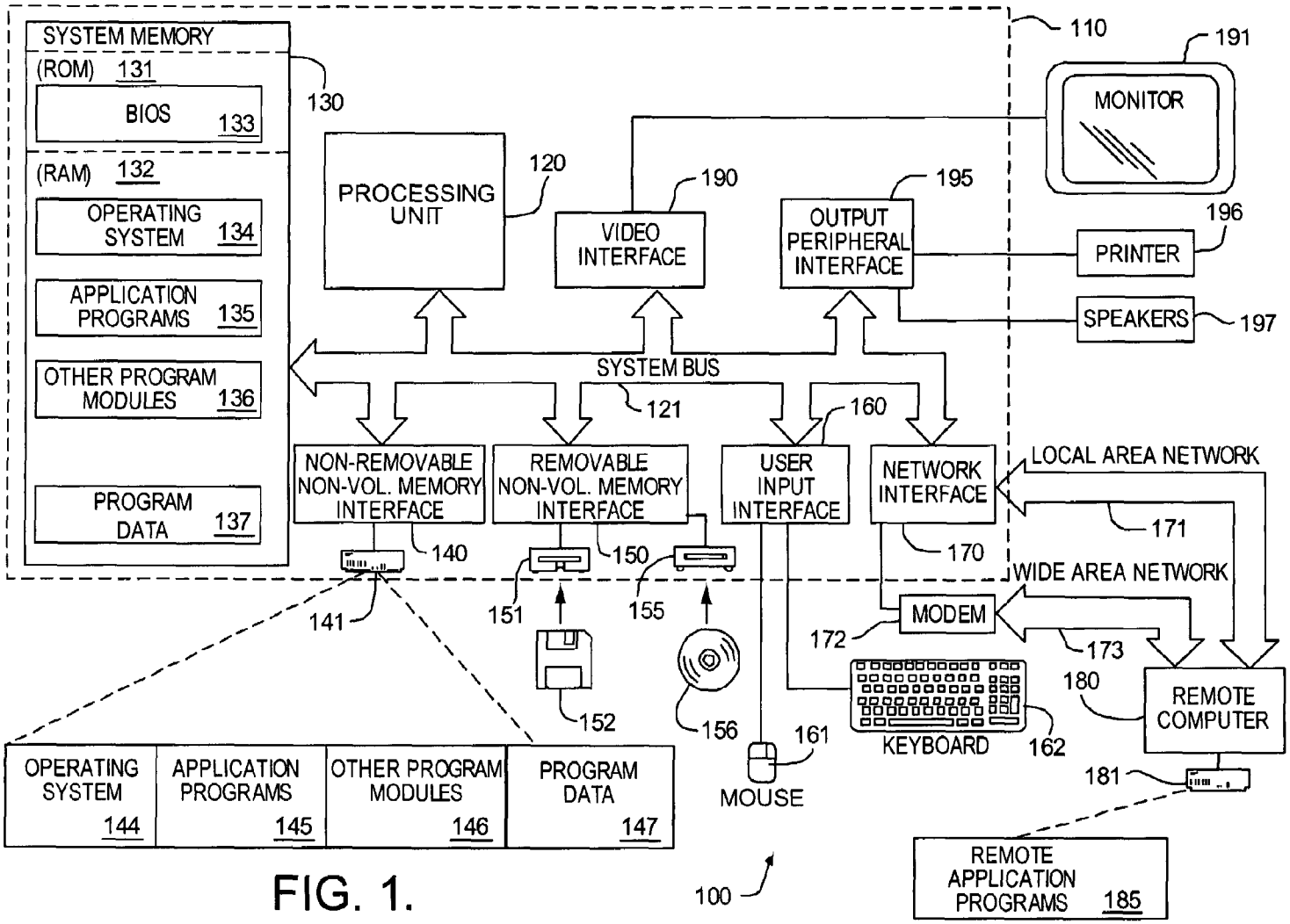
FIG. 1 is a block diagram of an exemplary computing environment suitable for use in implementing an embodiment of the present invention.

Referring to the drawings in general and initially to FIG. 1 in particular, wherein like reference numerals identify like components in the various figures, an exemplary operating environment for implementing the present invention is shown and designated generally as computing system environment 100. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well known computing systems, environments, and/or configurations that may be suitable for use with the invention include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like. Additionally, the invention is operational in other system environments including, but not limited to, game consoles, portable music players, car stereos, cellular telephones, personal information managers (PIMs), and the like.

The invention may be described in the general context of computer-executable instructions, such as program modules, being executed by a computer. Generally, program modules include routines, programs, objects, components, data structures, etc., that perform particular tasks or implement particular abstract data types. The invention may also be practiced in distributed computing environments where tasks are performed by remote processing devices that are linked through a communications network. In a distributed computing environment, program modules may be located in both local and remote computer storage media including memory storage devices.

With reference to FIG. 1, an exemplary system for implementing the present invention includes a general purpose computing device in the form of a computer 110. Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer-readable media. Computer-readable media can be any available media that can be accessed by computer 110 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer-readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 110. Communication media typically embodies computer-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer-readable media.

The system memory 130 includes computer storage media in the form of volatile and/or nonvolatile memory such as read only memory (ROM) 131 and random access memory (RAM) 132. A basic input/output system (BIOS) 133, containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable, volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks (DVDs), digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer-readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other programs 146 and program data 147 are given different numbers herein to illustrate that, at a minimum, they are different copies. A user may enter commands and information into the computer 110 through input devices such as a keyboard 162 and pointing device 161, commonly referred to as a mouse, trackball or touch pad. Other input devices (not shown) may include a microphone, joystick, game pad, satellite dish, scanner, or the like. These and other input devices are often connected to the processing unit 120 through a user input interface 160 that is coupled to the system bus, but may be connected by other interface and bus structures, such as a parallel port, game port or a universal serial bus (USB). A monitor 191 or other type of display device is also connected to the system bus 121 via an interface, such as a video interface 190. In addition to the monitor 191, computers may also include other peripheral output devices such as speakers 197 and printer 196, which may be connected through an output peripheral interface 195.

The computer 110 may operate in a networked environment using logical connections to one or more remote computers, such as a remote computer 180. The remote computer 180 may be a personal computer, a server, a router, a network PC, a peer device or other common network node, and typically includes many or all of the elements described above relative to the computer 110, although only a memory storage device 181 has been illustrated in FIG. 1. The logical connections depicted in FIG. 1 include a local area network (LAN) 171 and a wide area network (WAN) 173, but may also include other networks. Such networking environments are commonplace in offices, enterprise-wide computer networks, intranets and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the network interface 170, or other appropriate mechanism. In a networked environment, program modules depicted relative to the computer 110, or portions thereof, may be stored in a remote memory storage device. By way of example, and not limitation, FIG. 1 illustrates remote application programs 185 as residing on memory device 181. It will be appreciated that the network connections shown are exemplary and other means of establishing a communications link between the computers may be used.

Although many other internal components of the computer 110 are not shown, those of ordinary skill in the art will appreciate that such components and the interconnection are well known. Accordingly, additional details concerning the internal construction of the computer 110 need not be disclosed in connection with the present invention.

When the computer 110 is turned on or reset, the BIOS 133, which is stored in the ROM 131, instructs the processing unit 120 to load the operating system, or necessary portion thereof, from the hard disk drive 141 (or nonvolatile memory) into the RAM 132. Once the copied portion of the operating system, designated as operating system 144, is loaded in RAM 132, the processing unit 120 executes the operating system code and causes the visual elements associated with the user interface of the operating system 134 to be displayed on the monitor 191. Typically, when an application program 145 is opened by a user, the program code and relevant data are read from the hard disk drive 141 and the necessary portions are copied into RAM 132, the copied portion represented herein by reference numeral 135.

Transport Control for Initiating Play of Dynamically Rendered Audio Content

As previously mentioned, the present invention relates to a transport control for initiating play of dynamically rendered audio content selections that are rarely, if ever, played the same way twice. A transport control in accordance with the present invention may be provided as a user interface (UI) as shown in FIG. 2A or incorporated into a hardware device, e.g., a stand-alone music player, as shown in FIG. 2B.

Figure 2A:
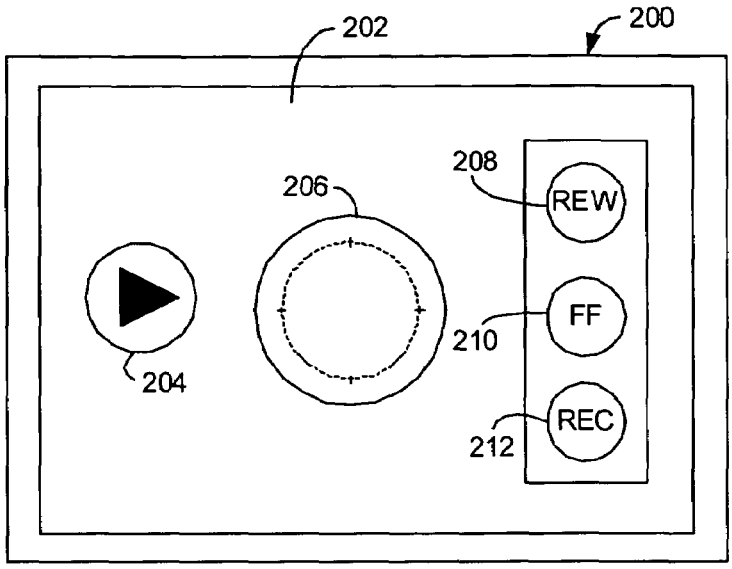
FIG. 2A is an illustrative screen display of an exemplary user interface (UI) in accordance with an embodiment of the present invention.
Figure 2B:
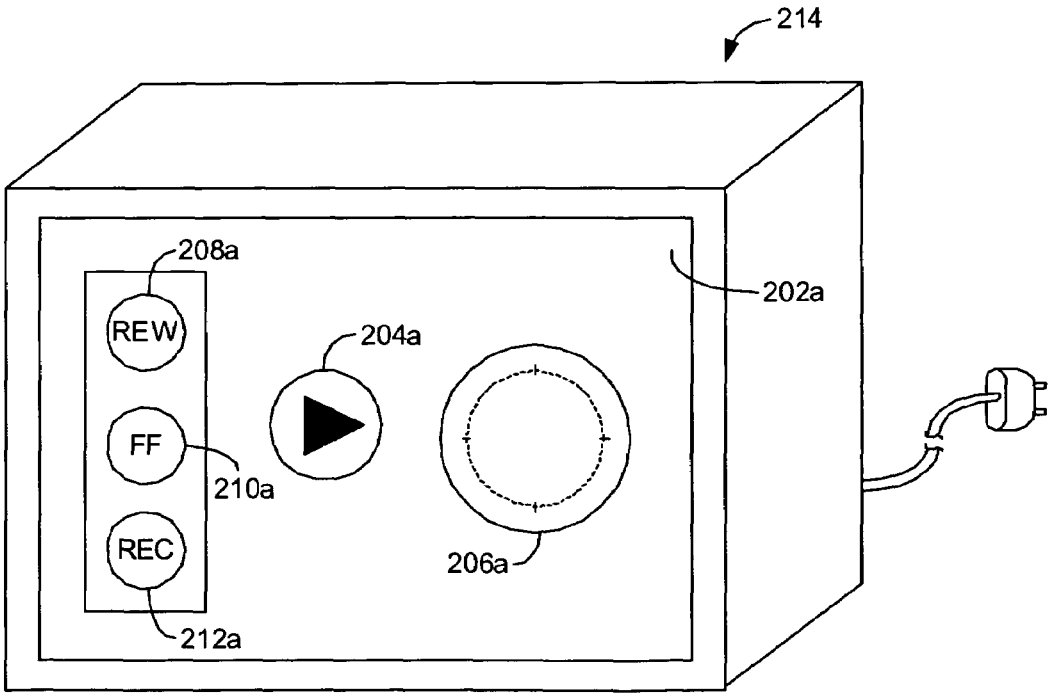
FIG. 2B is an illustrative hardware device incorporating a transport control in accordance with an embodiment of the present invention.

Referring to FIG. 2A, a UI 200 is shown having a transport control display area 202 which includes a play indicator display area 204 and a control indicator display area 206. The play indicator display area 204 shown in FIG. 2A is configured to display a play indicator which resembles a hardware or software play button of a standard audio content player. A user may select the play indicator, for instance, by hovering a mouse pointer over the play indicator and clicking a mouse button, to initiate play of dynamically rendered audio content, as more fully described below. In the illustrated transport control display area 202, the play indicator may also function as a stop indicator and, if desired, a pause indicator. Accordingly, it play of the audio content has already been initiated, a user may select the indicator a second time, for instance, by hovering over the indicator and single clicking a mouse button to pause play or may select the indicator, for instance, by hovering over the indicator and double clicking the mouse button to stop play. It will be understood and appreciated by those of ordinary skill in the art that a stop indicator display area (not shown) having a stop indicator and a pause indicator display area (not shown) having a pause indicator may be separately provided, if desired, so that the play indicator shown in the play indicator display area 204 will function only to initiate play. Such variations are contemplated to be within the scope hereof.

The control indicator display area 206 shown in FIG. 2A is configured to display a control indicator which resembles a rotatable knob. The control indicator includes a scale ranging, e.g., from low to high, from 1 to 10, or any other scale which provides a user with a plurality of selectable settings, either finite or analog-based, on which the control indicator may be set—each setting indicating a different type of audio content is to be output, as more fully described below. A user may select the control indicator, for instance by hovering a mouse pointer over the control indicator and clicking the mouse button. Clicking on one side of the control indicator may lower the setting and clicking on the other side of the control indicator may increase the setting. As more fully described below, the control indicator is linearly mapped to an interactive music engine having a plurality of component engines, each of which is controlled by the control indicator. As such, the control indicator is referred to herein as a "multi-purpose" control indicator to show that the control indicator has an affect on more than one aspect of the audio content that will be output from the playing device.

The transport control display area 202 of FIG. 2A further includes a rewind indicator display area 208, a fast forward indicator display area 210 and a record indicator display area 212. The rewind indicator display area 208 is configured to display a rewind indicator, the fast forward indicator display area 210 is configured to display a fast forward indicator, and the record indicator display area 212 is configured to display a record indicator. A user may select any of the indicators shown in display areas 208, 210, 212 by, for instance, hovering a mouse pointer over the indicator and clicking a mouse button to initiate the indicated action. It will be understood and appreciated by those of ordinary skill in the art that not all shown indicators are necessary to the present invention and, if desired, additional indicators may be present. The indicator display areas 208, 210, 212 shown are merely for illustrative purposes.

FIG. 2B illustrates a transport control 202*a* incorporated into a hardware device 214, e.g., a stand-alone music player. The hardware device 214 of FIG. 2B includes a play indicator 204*a* and a control indicator 206*a*. The play indicator 204*a* resembles a play button of a standard audio content player and, accordingly, a user may initiate play of dynamically rendered audio content by simply pressing the play indicator 204*a*. In the illustrated embodiment, the play indicator 204*a* may also function as a stop indicator and a pause indicator such that if play is already initiated, a rapid press of the play indicator 204*a* may pause play (a second rapid press re-initiating play when desired) whereas holding the play indicator 204*a* in a pressed position for a longer period of time may stop play. It will be understood and appreciated by those of ordinary skill in the art that a stop indicator and a pause indicator may be separately provided, if desired, so that the play indicator 204*a* will function only to initiate play. Such variations are contemplated to be within the scope of the present invention.

The control indicator 206*a* of FIG. 2B resembles a rotatable knob as may be seen on a standard audio content player. The control indicator 206*a* includes a scale ranging, e.g., from low to high, from 1 to 10, or any other scale which provides a user with a plurality of selectable settings, either finite or analog-based, on which the control indicator 206*a* may be set—each setting indicating a different type of audio content is to be output, as more fully described below. A user may rotate the control indicator 206*a*, for instance, to the left to decrease the setting and to the right to increase the setting. As more fully described below, the control indicator 206*a* is linearly mapped to an interactive music engine having a plurality of component engines, each of which is controlled by the control indicator 206*a*. As such, the control indicator 206*a* is referred to herein as a "multi-purpose" control indicator to show that the control indicator 206*a* has an affect on more than one aspect of the audio content that will be output from the playing device.

The transport control 202*a* of FIG. 2B further includes a rewind indicator 208*a*, a fast forward indicator 210*a*, and a record indicator 212*a* to indicate additional functions which the audio content playing device 214 is capable of performing. It will be understood by those of ordinary skill in the art, however, that not all of the shown indicators are necessary to the present invention and, if desired, additional indicators may be present, The indicators 208*a*, 210*a*, and 212*a* are shown merely for illustrative purposes.

As previously mentioned, the multi-purpose control indicator shown in the control indicator display area 206 of FIG.

Figure 3:
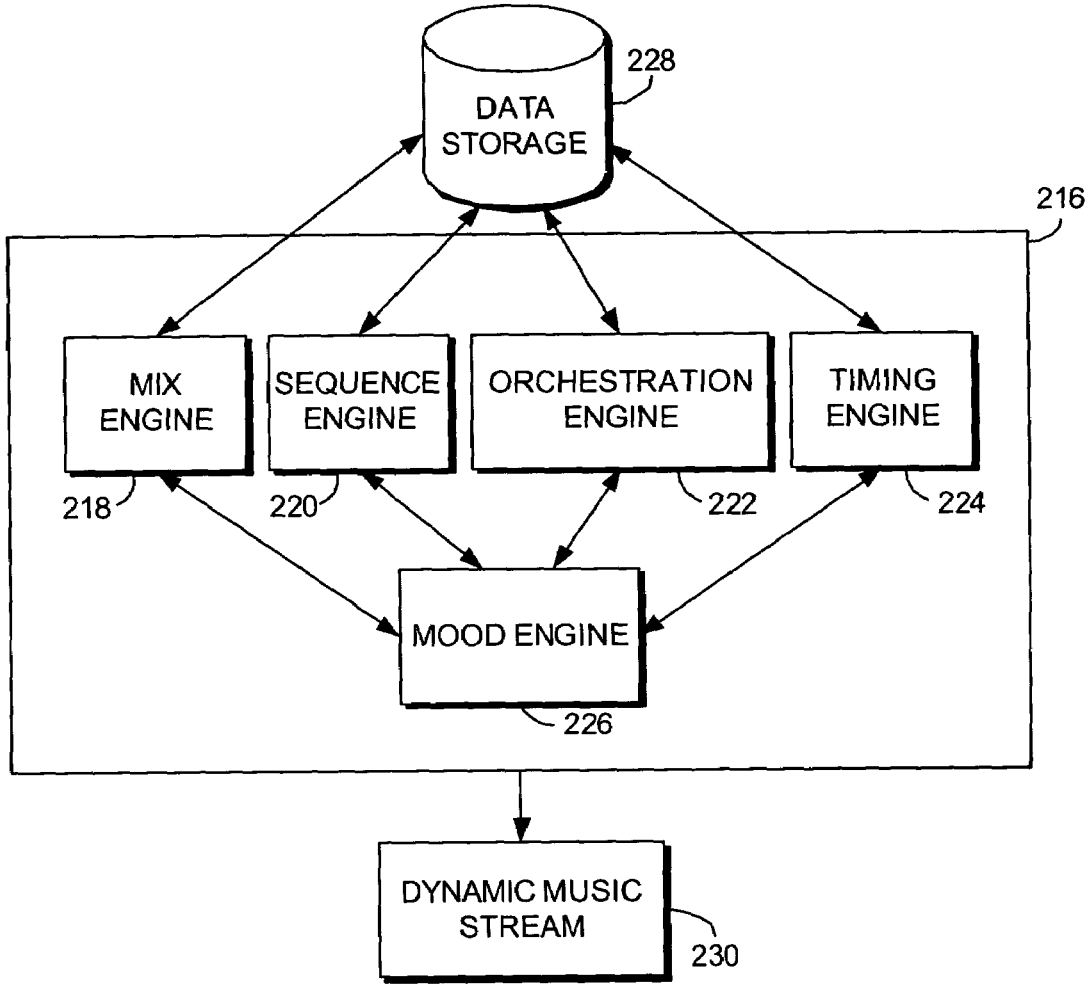
FIG. 3 is block diagram of an exemplary system architecture which is suitable for use in implementing the present invention.

2A and/or the multi-purpose control indicator 206*a* shown in FIG. 2B are linearly mapped to an interactive music engine having a plurality of component engines, each of which is controlled by the control indicator. Referring now to FIG. 3, a system architecture is shown which may be utilized with the transport controls described herein. The system includes an interactive music engine 216, five component engines, namely a mix engine 218, a sequence engine 220, an orchestration engine 222, a timing engine 224, and a mood engine 226. It will be understood and appreciated by those or ordinary skill in the art that the interactive music engine 216 shown in FIG. 3 is merely for illustrative purposes. The transport control of the present invention may be used with any number of music engines so long as a single multi-purpose control indicator may be linearly mapped thereto in such a way that a plurality of music components may be controlled thereby. All such variations are contemplated to be within the scope hereof.

The system of FIG. 3 further includes data storage 228 wherein audio content selections or sub-selections may be stored and from which audio content selections may be accessed by the various component engines, as more fully described below. The audio content may be stored as a plurality of captured audio content selections (e.g., multiple takes of a single musician's part of an audio content selection), each captured audio content selection being accessible by the interactive music engine 216. Alternatively, the audio content selections may be stored as, for example, Extensible Markup Language (XML), or a derivate or any scripted language thereof, such that dynamic recombination of the music elements comprising the audio content selections may be permitted upon access by the interactive music engine 216. Technologies for such dynamic recombination are known to those of ordinary skill in the art and, accordingly, are not further described herein.

The mix engine 218 is an intelligent engine which controls those music elements which make up the "mix" of a selection of audio content. "Mix" refers to a combination of music elements, each of which may be added or subtracted linearly from an audio content selection. For instance, contemplate an audio content selection having a horizontal set of elements and a vertical set of elements arranged such that they form a sort of grid pattern, each horizontal row and each vertical column comprising an individual channel which loosely maps to each musician that contributed to the audio content selection. The mix engine 218 is an intelligent engine which determines which of the channels shall remain in a particular rendition of the audio content selection and which channels shall be removed therefrom, as well as the relative volume of those channels that remain in the rendition with respect to one another. Accordingly, the mix engine 218 may control a dozen or more music elements for a particular audio content selection.

The sequence engine 220 is an intelligent engine which controls those music elements which comprise the "sequence" of a selection of audio content. An audio content selection may typically be broken down into a plurality of segments, for instance, verses, choruses, bridges, movements, and the like. "Sequence" refers to the order in which these segments are arranged in a particular rendition of an audio music selection. As with the mix engine 218, the sequence engine 220 may control a dozen or more music elements for a particular audio content selection.

The orchestration engine 222 is an intelligent engine which controls those music elements which comprise the orchestration or timbre of an audio content selection. More particularly, the orchestration engine 222 controls the actual rendered timbre of each of the channels of an audio content selection. For instance, if a particular channel representing a violin solo is determined to remain in a rendition of a piece of music (by the mix engine 218, as described above), the orchestration engine 222 would determine whether the violin solo is to be output sounding like a violin or output in such a way that it sounds more like, for instance, a cello. In other words, the orchestration engine 222 controls the sonic characteristics of each channel of an audio content selection. As such, the orchestration engine 222 may also control any number of music elements for a particular audio content selection.

The timing engine 224 is an intelligent engine which controls those music elements which influence the temporal aspects of an audio content selection. Such time aspects may include syncopation, rhythmic feel, tempo, time signature, and the like. As each of these aspects may be applied to each channel of an audio content selection, the timing engine 224 may control dozens or more music elements for a particular audio content selection.

The mood engine 226 is an intelligent engine which controls those music elements which affect the mood of a particular audio content selection. "Mood" is a fairly subjective component of an audio content selection but is important in ensuring a musically pleasing output. Accordingly, the mood engine 226 may be thought of as the brain of the dynamic rendering process. In the system illustrated in FIG. 3, the mood engine 116 is shown as receiving inputs (as more fully described below) from each of the other four component engines (the mix engine 218, the sequence engine 220, the orchestration engine 222, and the timing engine 224). Once these inputs are received, the function of the mood engine 226 is to determine whether or not the combination of inputs will render a musically pleasing output.

Figure 4:
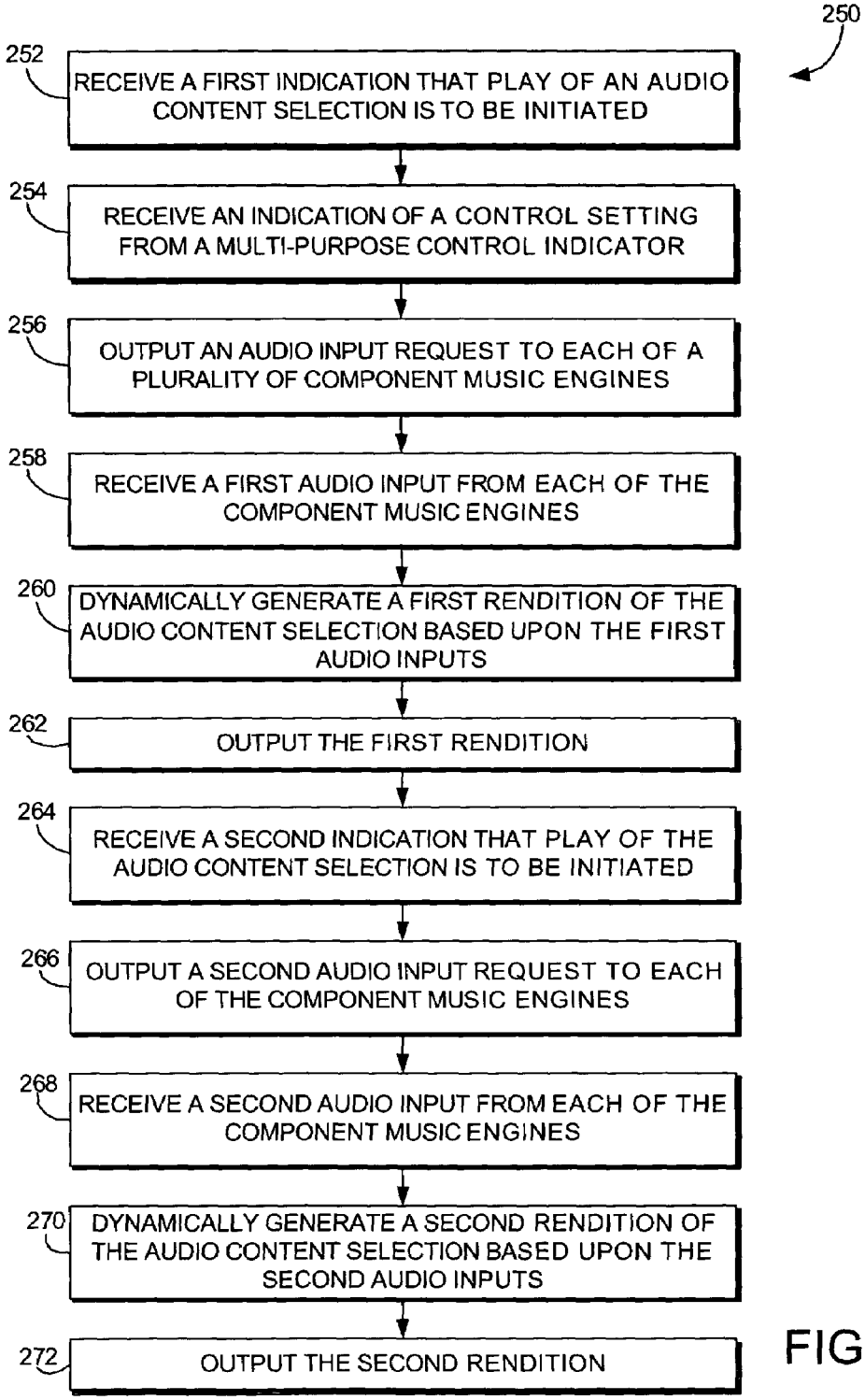
FIG. 4 is a flow diagram illustrating a method for initiating play of dynamically rendered audio content in accordance with an embodiment of the present invention.

Referring to FIG. 4, an exemplary method for initiating play of dynamically rendered audio content is illustrated and designated generally as reference numeral 250. Initially, as shown at block 252, the system receives an indication that play of an audio content selection is to be initiated. That is, a user either hovers over the play indicator of the play indicator display area 204 of the UI 200 of FIG. 2A and clicks the mouse button or presses the play indicator 204*a* of the stand-alone audio content playing device 214 of FIG. 2B. The system then determines the control setting on which the control indicator is set. Again, this may be either the control indicator of the control indicator display area 206 of the UI 200 of FIG. 2A or the control indicator 206*a* of the stand-alone audio content playing device 214 of FIG. 2B. This step is shown at block 254 of FIG. 4.

Subsequently, the system transmits an audio input request to each of the mix engine 218, the sequence engine 220, the orchestration engine 222 and the timing engine 224 (FIG. 3), each audio input request requesting audio input from the component engines which is consistent with the control setting. This is shown at block 256. Subsequently, the mix engine 218, the sequence engine 220, the orchestration engine 222, and the timing engine 224 access audio content from the data storage 228 (FIG. 3), determine an audio content input to be added to the audio output, and provide the audio content inputs to the mood engine 226. If the audio content selections are stored as captured selections, each of the mix engine 218, the sequence engine 220, the orchestration engine 222, and the timing engine 224 may simply select one of the audio content selections to input. If, however, the audio content selections are stored in a format which permits dynamic recombination thereof, each of the mix engine 218, the sequence engine 220, the orchestration engine 222 and the timing engine 224 may dynamically generate the audio input it will contribute. The respective audio content inputs are subsequently received by the mood engine 226 (FIG. 3), as shown at block 258.

The mood engine 226 examines the component inputs, determines whether or not a musically pleasing output will be rendered based upon the interaction therebetween and, if so, causes the interactive music engine 216 to dynamically generate a rendition of the audio content selection based on the audio inputs. This is shown at block 260 of FIG. 4. If the output would not be musically pleasing, the mood engine 226 may request a different audio input from one or more of the mix engine 218, the sequence engine 220, the orchestration engine 222, and the timing engine 224.

The interactive music engine 216 (FIG. 3) subsequently outputs a dynamic music stream 230 (FIG. 3) representing the generated rendition of the audio content selection as indicated at block 262 of FIG. 4.

The spectrum of possible audio content outputs from the above method is vast. For instance, contemplate a user has selected a Peter Gabriel song for their listening pleasure. If the control indicator is set at a high level, a version wherein it feels as if there are forty musicians playing, right in the user's home may be output from the interactive music engine 216 so that the user feels as if they are present at a Peter Gabriel concert. However, if the control indicator is set at a low level, a version of the same Peter Gabriel song may be output from the interactive music engine 216 wherein it sounds as if Peter Gabriel is sitting at the piano and singing the song without further accompaniment. It's the same song, the same composition, and the same essence to the piece of music, it's just stripped down to its bare essence and elements in one instance and output with the intensity of a live concert performance in the other.

If a user desires to listen to the same audio content selection a second time, he or she may initiate play of the selection by selecting the play indicator once again. The system would then receive a second indication that play of the audio content selection is to be initiated, as shown at block 264. The system then determines the control setting on which the control indicator is set. In the present scenario, contemplate that the control setting has not changed. The system subsequently transmits an audio input request to each of the mix engine 218, the sequence engine 220, the orchestration engine 222 and the timing engine 224 (FIG. 3), each audio input request again requesting audio input from the component engines which is consistent with the control setting. This is shown at block 266. Subsequently, the mix engine 218, the sequence engine 220, the orchestration engine 222, and the timing engine 224 access audio content from the data storage 228 (FIG. 3), determine an audio content input to be added to the audio output, and provide the audio content input to the mood engine 226, as shown at block 268. The mood engine 226 examines the component inputs, determines whether or not a musically pleasing output will be rendered based upon the interaction therebetween and, if so, causes the interactive music engine 216 to dynamically generate a second rendition of the audio content selection based upon the second audio inputs. This is shown at block 270. The interactive music engine 216 (FIG. 3) subsequently outputs a dynamic music stream 230 (FIG. 3) representing the generated rendition of the audio content selection as indicated at block 272 of FIG. 4.

Even though the control setting on the control indicator remained unchanged, it is very unlikely that the first rendition of the audio content selection and the second rendition of the audio content selection will be the same. This is due to the fact that each of the component engines contributing to the audio content output control dozens or more music elements and the chances that upon audio input request, the component engines will select the exact same combination of audio inputs to contribute to the output is are extremely slim. Accordingly, as upon altering a single multi-purpose control indicator, multiple components and music elements of the output are affected, a dynamic performance is rendered which will rarely, if ever, be played the same way twice. As such, the user is provided with a listening experience which simulates a live performance. Additionally, the user is provided with this experience by providing little input and/or decision making but merely the simple selection of a play indicator.

It will be understood and appreciated by those of ordinary skill in the art that the illustrated system architecture and interactive music engine 216 described herein are for illustrative purposes only and are not necessary for the transport control of the present invention. Any transport control having a single multi-purpose control indicator linearly mapped to multiple component engines, each of which is controlled by the control indicator is intended to be within the scope hereof. Further, additional control indicators, for instance, mapped to individual component engines, may also be present in the transport control of the present invention as long as at least one control indicator is "multi-purpose" in that it controls multiple component engines.

As can be understood, the present invention provides a transport control, e.g., for use with an audio content playing device, the transport control for initiating play of dynamically rendered audio content selections that are rarely, if ever, played the same way twice. The present invention further provides a transport control that permits a user to initiate play of dynamically rendered music selections with little input and/or decision making.

The present invention has been described in relation to particular embodiments which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated and within the scope of the claims.

This invention claimed is:

1. A computer-implemented method for initiating play of dynamically rendered audio content, comprising:

receiving a first indication that play of an audio content selection is to be initiated;

receiving an indication of a control setting from a multi-purpose control indicator;

outputting an audio input request to each of a plurality of component music engines, each of which is controlled by the multi-purpose control indicator;

receiving a first audio input from each of the plurality of component music engines consistent with the control setting;

dynamically generating a first rendition of the audio content selection based upon the received first audio inputs;

outputting the first rendition of the dynamically generated audio content selection;

receiving a second indication that play of the audio content selection is to be initiated;

outputting a second audio input request to each of the plurality of component music engines;

receiving a second audio input from each of the plurality of component music engines consistent with the control setting;

dynamically generating a second rendition of the audio content selection based upon the received second audio inputs; and outputting the second rendition of the dynamically generated audio content selection, wherein the first rendition and the second rendition are different from one another.

2. The computer-implemented method of claim 1, wherein each component music engine of the plurality of component music engines independently controls a plurality of music elements.

3. The computer-implemented method of claim 1, wherein each component music engine of the plurality of component music engines is one of a mix engine, an orchestration engine, a timing engine, and a mood engine.

4. The computer-implemented method of claim 1, wherein one of the plurality of component music engines is a mood engine, and wherein at least one additional component music engine of the plurality of component music engines is linearly mapped to the multi-purpose control indicator through the mood engine.

5. The computer-implemented method of claim 1, wherein the control setting indication received from the multi-purpose control indicator represents a scale.

6. One or more computer-readable media having computer-executable instructions embodied thereon that, when executed, perform a method for initiating play of dynamically rendered audio content, the method comprising:

receiving a first indication that play of an audio content selection is to be initiated;

receiving an indication of a control setting from a multi-purpose control indicator;

outputting an audio input request to each of a plurality of component music engines, each of which is controlled by the multi-purpose control indicator;

receiving a first audio input from each of the plurality of component music engines consistent with the control setting;

dynamically generating a first rendition of the audio content selection based upon the received first audio inputs;

outputting the first rendition of the dynamically generated audio content selection;

receiving a second indication that play of the audio content selection is to be initiated;

outputting a second audio input request to each of the plurality of component music engines;

receiving a second audio input from each of the plurality of component music engines consistent with the control setting;

dynamically generating a second rendition of the audio content selection based upon the received second audio inputs; and outputting the second rendition of the dynamically generated audio content selection, wherein the first rendition and the second rendition are different from one another.

7. The one or more computer-readable media of claim 6, wherein each component music engine of the plurality of component music engines independently controls a plurality of music elements.

8. The one or more computer-readable media of claim 6, wherein each component music engine of the plurality of component music engines is one of a mix engine, an orchestration engine, a timing engine, and a mood engine.

9. The one or more computer-readable media of claim 6, wherein one of the plurality of component music engines is a mood engine, and wherein at least one additional component music engine of the plurality of component music engines is linearly mapped to the multi-purpose control indicator through the mood engine.

10. The one or more computer-readable media of claim 6, wherein the control setting indication received from the multi-purpose control indicator represents a scale.

* * * * *